US010589164B2

(12) United States Patent
Lennon et al.

(10) Patent No.: US 10,589,164 B2
(45) Date of Patent: Mar. 17, 2020

(54) RETRACTABLE SPORT SCREEN

(71) Applicant: The SportScreen Ltd., Kitchener (CA)

(72) Inventors: Russell Patrick Lennon, Kitchener (CA); Mark Albert Shaver, Kitchener (CA)

(73) Assignee: The Sportscreen Ltd., Kitchener, Ontario (CA)

( * ) Notice: Subject to any disclaimer, the term of this patent is extended or adjusted under 35 U.S.C. 154(b) by 0 days.

(21) Appl. No.: 15/805,834

(22) Filed: Nov. 7, 2017

(65) Prior Publication Data

US 2018/0126245 A1 May 10, 2018

(30) Foreign Application Priority Data

Nov. 7, 2016 (GB) ..... 1618739.5

(51) Int. Cl.

*A63B 71/02* (2006.01)
*A63B 63/00* (2006.01)
*A63B 69/00* (2006.01)

(52) U.S. Cl.

CPC ..... *A63B 71/022* (2013.01); *A63B 63/004* (2013.01); *A63B 69/0026* (2013.01); *A63B 2063/006* (2013.01); *A63B 2209/00* (2013.01); *A63B 2209/10* (2013.01); *A63B 2210/56* (2013.01)

(58) Field of Classification Search

CPC ..... A63B 71/02; A63B 69/00; A63B 63/00
USPC ..... 473/197, 434, 421
See application file for complete search history.

(56) References Cited

U.S. PATENT DOCUMENTS 2,992,002 A * 7/1961 Bingham, Jr. ..... A63B 69/0097 273/395
4,140,313 A * 2/1979 Martin ..... A63B 69/0097 473/434
4,153,246 A * 5/1979 Byrne ..... A63B 63/00 160/113
4,183,524 A * 1/1980 Kifferstein ..... A63B 63/00 473/197

(Continued)

OTHER PUBLICATIONS

Sniper's Edge Hockey Shooting Tarp product information page, Sniper's Edge LLC, downloaded from https://www.snipersedgehockey.com/collections/featured-products/products/snipers-edge-hockey-shooting-tarp on Apr. 10, 2018.

*Primary Examiner* — Eugene L Kim
*Assistant Examiner* — Christopher Glenn
(74) *Attorney, Agent, or Firm* — Bereskin & Parr LLP

(57) ABSTRACT

A retractable sport screen is described. The sport screen includes a head roll mountable to a structure and a screen couplable to the head roll tube being movable between a first position and a second position. The screen is rolled up around the head roll tube when in the first position and extended towards a ground when in the second position. The screen further includes a middle bar received in a first pocket of the screen and spaced from the head roll when the screen is in the second position, a bottom bar received in a second pocket of the screen and spaced from the middle bar in a direction away from the head roll when the screen is in the second position, the bottom bar being weighted to provide tension to the screen to inhibit a launched projectile striking the screen from contacting the structure when the screen is in the second position, and a mounting assembly for mounting the head roll to the structure.

19 Claims, 6 Drawing Sheets

(56) References Cited

U.S. PATENT DOCUMENTS

| | | | | | |
|---|---|---|---|---|---|
| 4,523,760 | A * | 6/1985 | Bednarczuk | A63B 24/0021 | 473/197 |
| 5,007,645 | A * | 4/1991 | Weigl | A63B 63/00 | 273/407 |
| 5,116,056 | A * | 5/1992 | Schmutte | A63B 63/00 | 160/330 |
| 5,205,564 | A * | 4/1993 | Lamberti | A63B 63/004 | 273/400 |
| 5,527,032 | A * | 6/1996 | Coleman | A63B 63/00 | 273/410 |
| 5,947,831 | A * | 9/1999 | McCarthy | A63B 63/00 | 473/197 |
| 6,074,313 | A * | 6/2000 | Pearson | A63B 63/083 | 273/394 |
| 6,189,889 | B1 * | 2/2001 | Yip | A63B 63/00 | 273/348 |
| 6,482,112 | B1 * | 11/2002 | Betz | A63B 71/022 | 473/421 |
| 6,485,373 | B1 * | 11/2002 | Stephens | A63B 63/00 | 473/162 |
| 8,246,494 | B2 * | 8/2012 | Stephenson | A63B 63/004 | 473/422 |
| 2005/0101419 | A1 * | 5/2005 | Pohrer | A63B 61/00 | 473/421 |
| 2005/0134001 | A1 * | 6/2005 | Rowan | A63B 63/00 | 273/401 |
| 2012/0322567 | A1 * | 12/2012 | Manieri | A63B 69/36 | 473/151 |

* cited by examiner

RETRACTABLE SPORT SCREEN

TECHNICAL FIELD

The embodiments disclosed herein relate to sports screens, and, in particular to temporary retractable sports containment screens.

BACKGROUND

Many different sports require a player to launch a projectile (e.g. a ball, puck or the like) towards a goal or target. For a player to improve their eye hand coordination, they typically practice by launching projectiles towards an unattended goal or a target. During practice, players typically do not hit the goal or the target with every launched projectile and, when the goal or target is positioned in front of a structure, this can lead to the launched projectile striking and damaging the structure.

Sports screens or shields have been developed to be used as training aids with goals or targets. These screens or shields may are typically positioned either on or around a goal or target to prevent a launched projectile that misses the goal or target from travelling a great distance beyond the goal or target or striking a structure behind the goal or target.

Depending on the type of goal or target being used for practice, the sports screens or shields currently available can be very large in size and therefore cumbersome to position on or around the goal or target.

Accordingly, there is a need for new or improved retractable sports screens.

SUMMARY

According to an embodiment, a retractable sport screen is provided. The sport screen includes a head roll mountable to a structure and a screen couplable to the head roll tube being movable between a first position and a second position. The screen is rolled up around the head roll tube when in the first position and extended towards a ground when in the second position. The screen further includes a middle bar received in a first pocket of the screen and spaced from the head roll when the screen is in the second position, a bottom bar received in a second pocket of the screen and spaced from the middle bar in a direction away from the head roll when the screen is in the second position, the bottom bar being weighted to provide tension to the screen to inhibit a launched projectile striking the screen from contacting the structure when the screen is in the second position, and a mounting assembly for mounting the head roll to the structure.

The head roll may comprise a head roll tube and an axle extending from each end of the head roll.

The mounting assembly may comprise a mounting bracket mountable to the structure and a drop-in bracket securable to the mounting bracket, the drop-in bracket having a receiver for receiving the axle.

The drop-in bracket may be secured to the mounting bracket by fasteners, each fastener extending through one of a plurality of securing holes of the drop-in bracket and a corresponding one of a plurality of fitment holes of the mounting bracket.

The plurality of fitment holes of the mounting bracket may be radially aligned with and radially spaced from a central point of the mounting bracket, the central point defined by an axis of the axles.

One of the axles may extend from a first side of the head roll and comprise an annular retaining groove that engages the receiver of the drop-in bracket for the drop-in bracket to receive the axle.

The mounting assembly may comprise a gear box for rotating the head roll and moving the screen between the first and second positions.

The mounting assembly may further comprise a side bracket and a gear box drive, the gear box being positioned between the side bracket and the gearbox drive, the gear box drive engagable with one of the axles extending from a second side of the head roll.

The middle bar may comprise two components telescopically engaged with a middle bar joiner.

The bottom bar may comprise two components telescopically engaged with a bottom bar joiner.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of articles, methods, and apparatus of the present specification. In the drawings.

DETAILED DESCRIPTION

Various apparatus or processes will be described below to provide an example of each claimed embodiment. No embodiment described below limits any claimed embodiment and any claimed embodiment may cover processes or apparatus that differ from those described below. The claimed embodiments are not limited to apparatus or processes having all of the features of any one apparatus or process described below or to features common to multiple or all of the apparatus described below.

Figure 1:
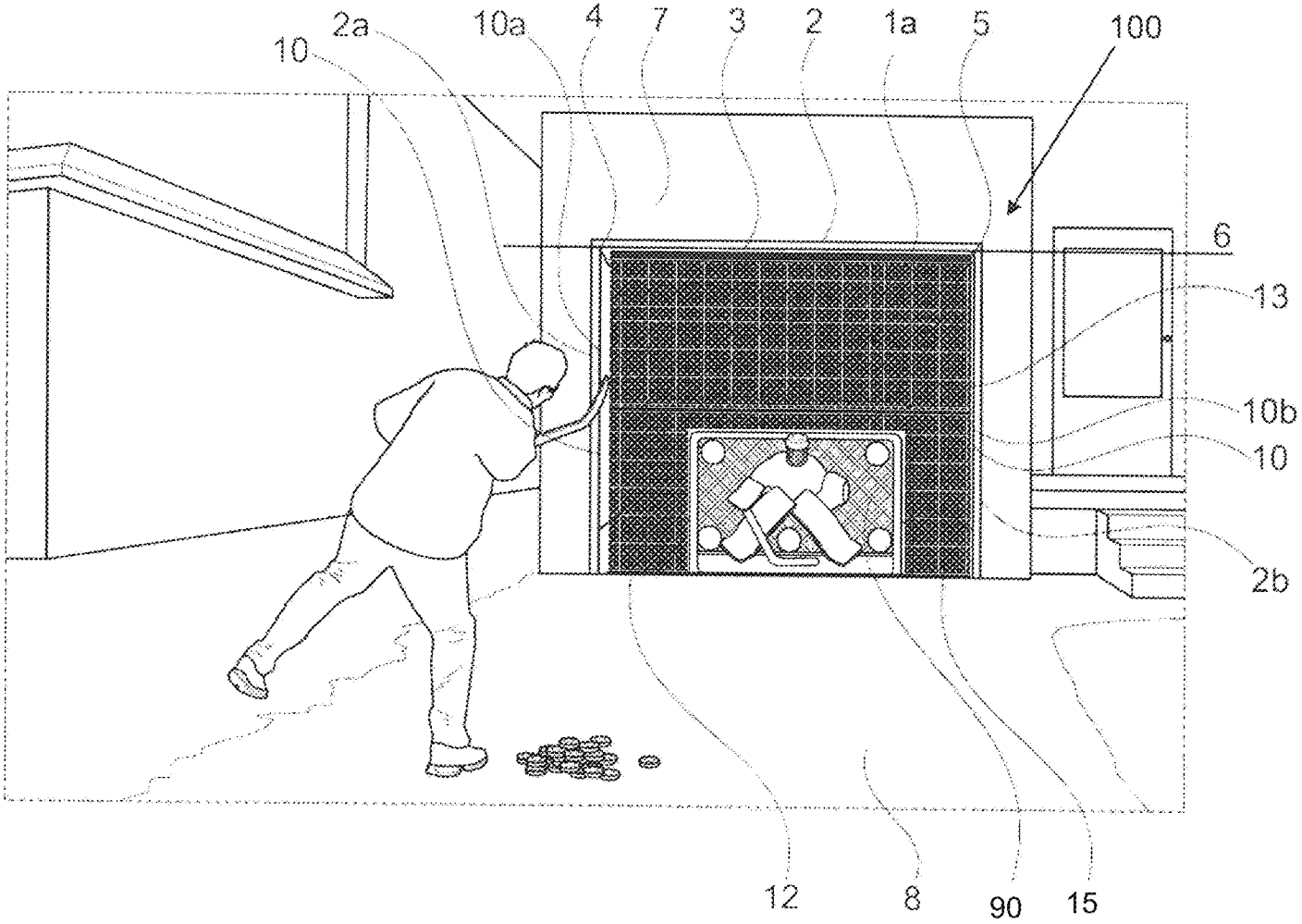
FIG. 1 is a pictorial elevation of a sports screen, installed and in use, according to one embodiment.

Turning to the Figures, FIG. 1 is a pictorial elevation of a fully operational retractable sports screen 100 according to one embodiment. Sports screen 100 can be mounted to a structure 2. In the embodiment shown in FIG. 1, the sports screen 1 is installed to a garage door frame of a standard suburban home 2 by way of a head roll 1*a* being secured to frame 2 at its port-side lateral end 4 and its starboard-side lateral end 5 for rotation of the head roll 1*a* about a horizontal axis 6 lying substantially parallel to the garage door opening (not shown), the face of the building 7 and the driveway playing surface 8.

Figure 3:
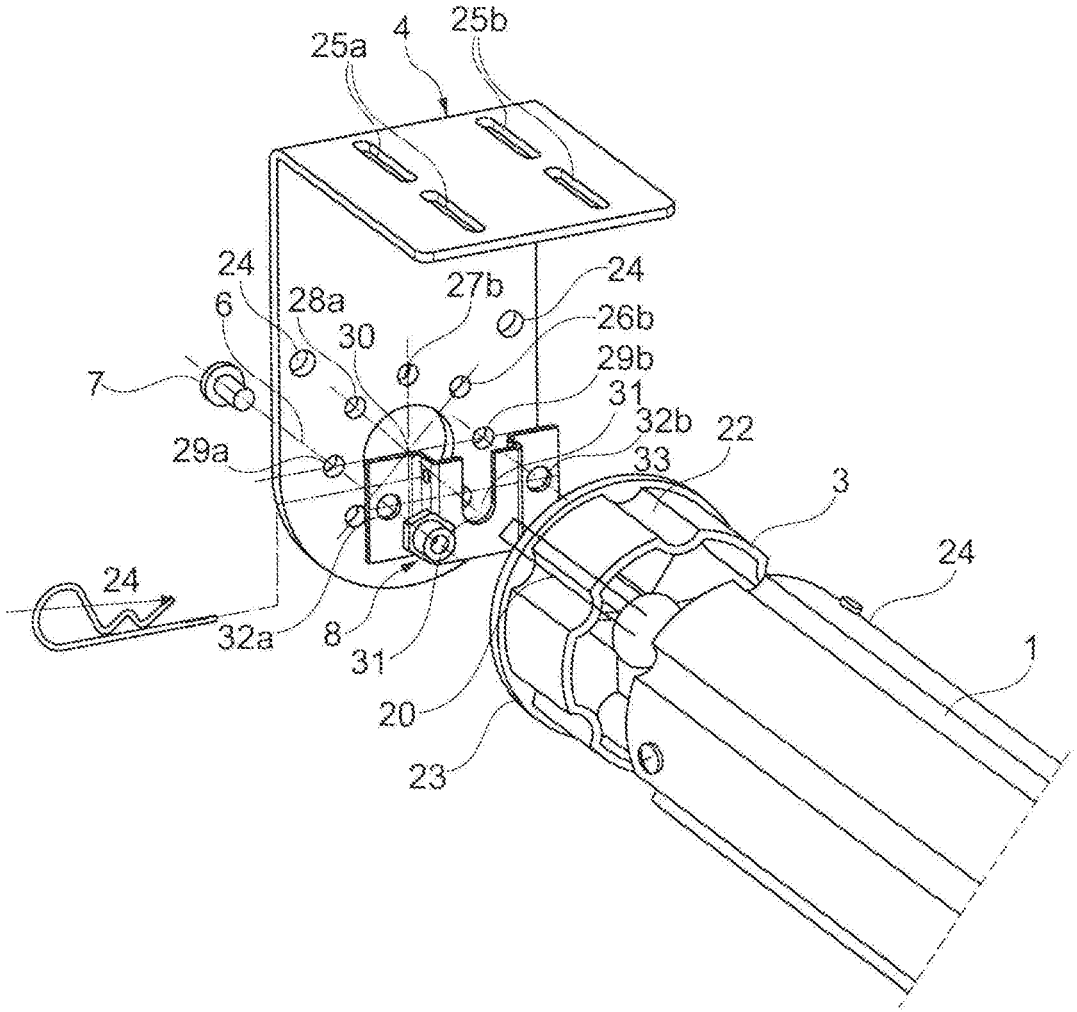
FIG. 3 is an expanded exploded view of the port side of the main head roll of the sport screen of FIG. 1, according to one embodiment.
Figure 4:
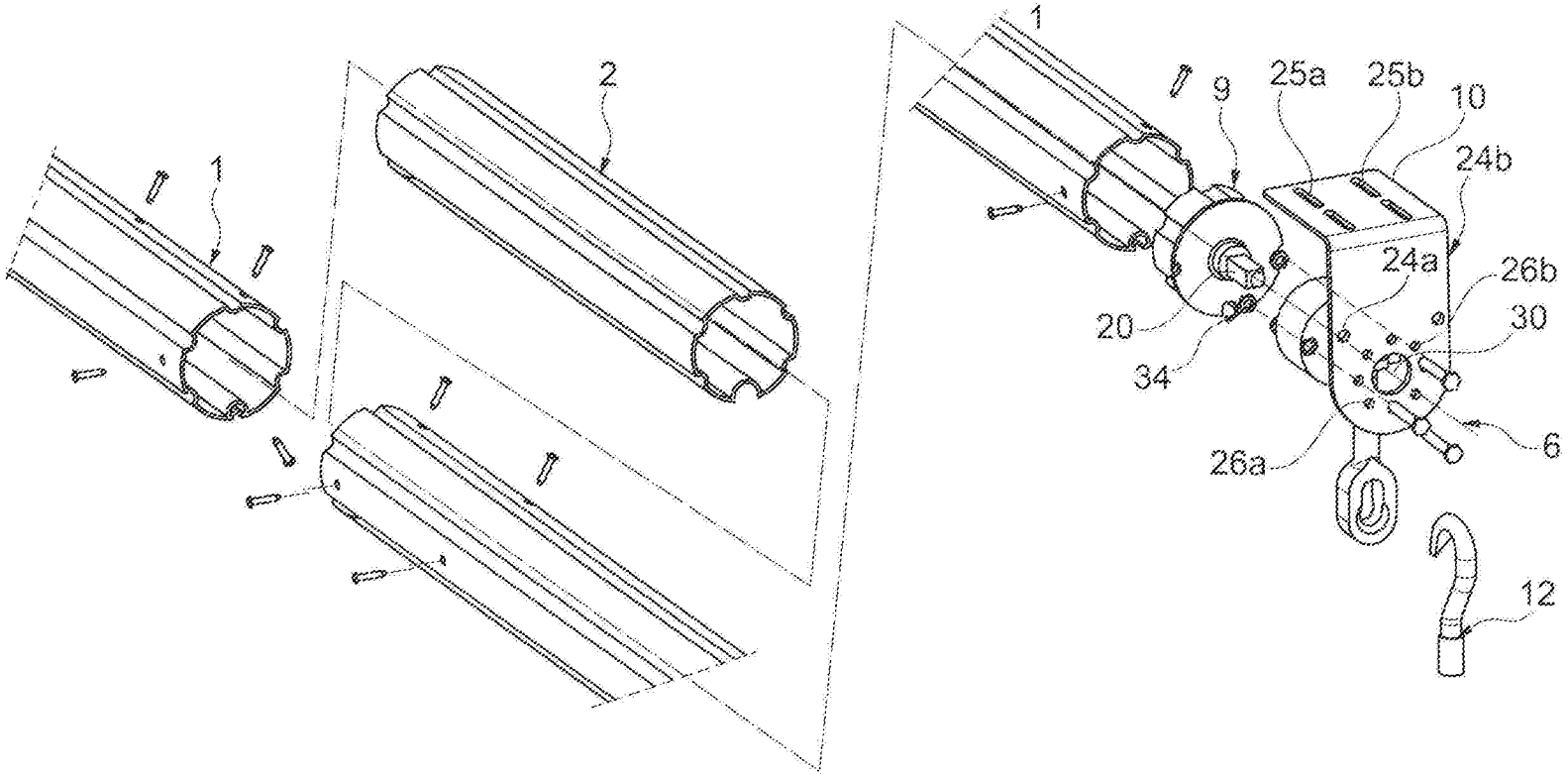
FIG. 4 is an expanded exploded view of the starboard side of the main head roll of the sport screen of FIG. 1, according to one embodiment.

Head roll 1*a* includes a head roll tube 1 and at least one axle 20 extending therefrom (see FIGS. 3 and 4).

A screen (e.g. fabric) 10 of sports screen 100 may be fabricated from a flexible sheet material, optionally including an open mesh array as shown, and may include a printed or attached overlay 90 depicting a shooters target for a particular sport, such as but not limited to hockey, as shown in FIG. 1.

At its lower extremity when in operation, sports screen 100 includes a weighted bottom bar 15 extending across the full width of the sports screen 100 between garage port-side-wall 2*a* and starboard-side-wall 2*b*.

Sports screen 100, in use, may extend the full height of a garage door opening from head roll 1*a* to bottom bar 15 which may be in contact with or just above a surface of the ground. In one embodiment, bottom bar 15 is just above the surface of the ground to tension screen 10 vertically and not leave any space below the bar 15, as shown in FIG. 1 at 12. Lateral edges, port-side 10*a* and starboard-side 10*b*, of fabric face 10 are preferably not connected to door frame sides 2*a* or 2*b*.

At about its mid-height (see FIG. 1) when in operation (e.g. at about a mid-height of the garage), sports screen 100 includes a horizontal middle bar 13 (e.g. fabricated of fiberglass) which may be contained within a transverse pocket 40 in the flexible sheet (e.g. fabric) 10 and floats laterally from lateral edge 10 *a* to lateral edge 10 *b* without restraint other than the pocket 40 and its internal friction.

As shown in FIG. 1, the energy from an impact of a projectile such as a hockey puck contacting the sports screen 100 (e.g. contacting screen 10) is absorbed primarily across a face of screen 10 with minimal indentation or edge distortions which might leave an opening, partially from elevation of the screen 10 and the bottom bar 15 against gravity.

Figure 2:
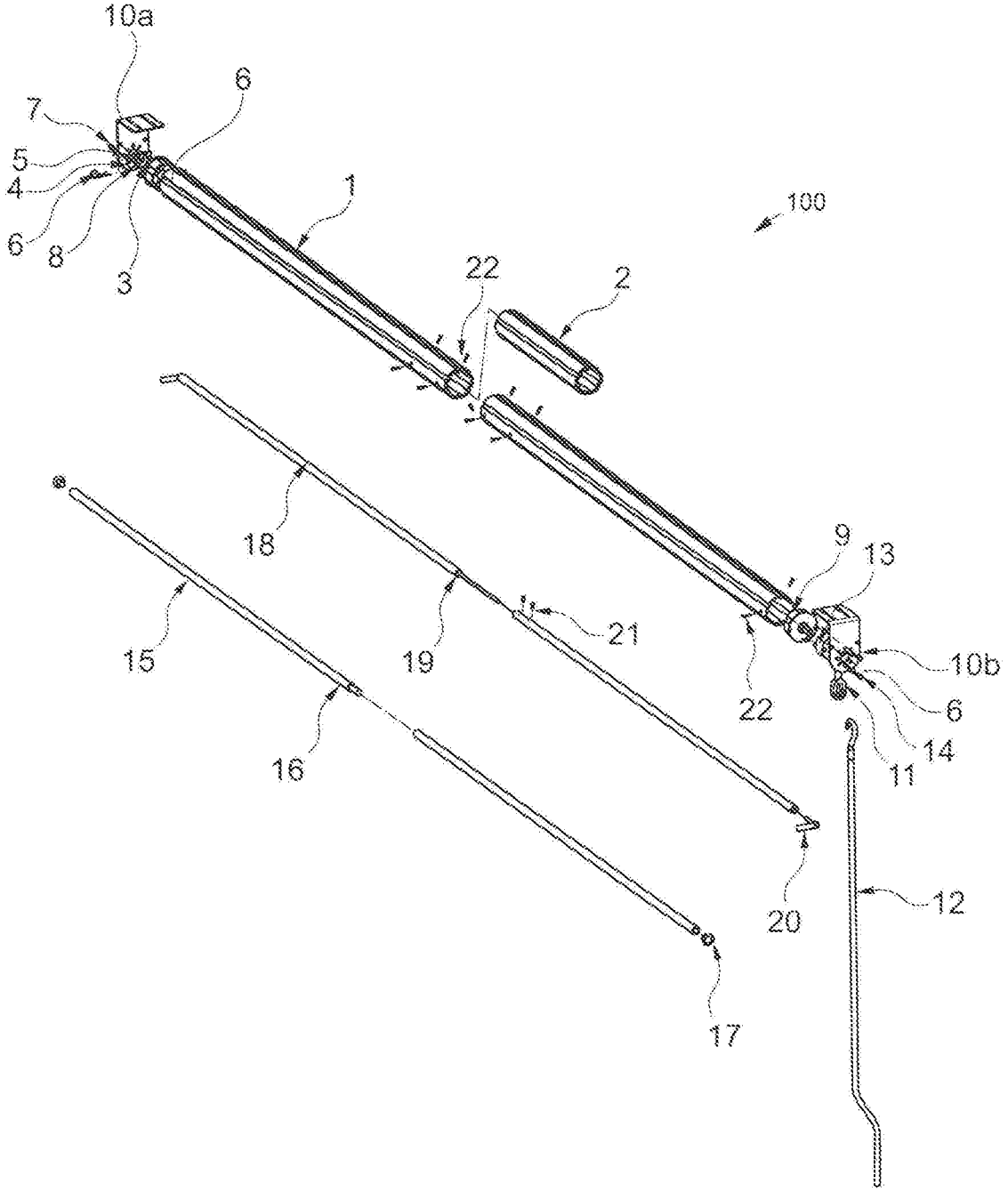
FIG. 2 is an exploded perspective view of the sports screen of FIG. 1, not including the screen itself, according to one embodiment.

FIG. 2 shows an exploded view of the sports screen 100, without screen 10. The individual components and associated reference numerals herein are identified in the Bill of Materials set out below.

BILL OF MATERIALS

| No. | Description | Qty |
|---|---|---|
| 1 | HEAD ROLL TUBE | 2 |
| 2 | HEAD ROLL JOINER | 1 |
| 3 | IDLER END | 1 |
| 4 | ANGLE BRACKET | 1 |
| 5 | DROP IN BRACKET | 1 |
| 6 | LOCK PIN IDLER END | 1 |
| 7 | SCREW, PAN HD, 6-32 × ½ LG, SST | 2 |
| 8 | NYLOCK NUT | 2 |
| 9 | GEARBOX DRIVE | 1 |
| 10 | ANGLE BRACKET | 1 |
| 11 | GEAR BOX | 1 |
| 12 | CRANK HANDLE | 1 |
| 13 | NYLOCK NUT | 3 |
| 14 | BOLT, HEX | 3 |
| 15 | BOTTOM BAR | 2 |
| 16 | JOINER BOTTOM | 1 |
| 17 | BOTTOM BAR END | 2 |
| 18 | MIDDLE BAR (FIBREGLASS) | 2 |
| 19 | MIDDLE BAR JOINER | 1 |
| 20 | MIDDLE BAR END CAP VELCRO | 2 |
| 21 | PHILLIPS SCREW ½ | 4 |
| 22 | PHILLIPS SCREW ¾ | 18 |

The head roll 1*a* in FIG. 1 may include a port section and a starboard section, each section telescoped over a head roll joiner 2 for torque transmission by means of a joiner exterior profile matching the interior profile of each of the head roll tube sections and further secured by threaded fasteners 22.

Figure 6A:
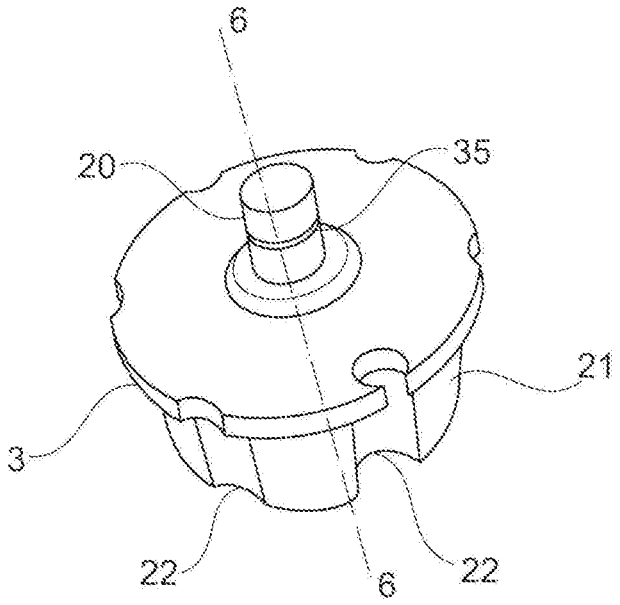
FIGS. 6A and 6B are, respectively, a pictorial perspective and a pictorial elevation of the idler end component of the head roll of the sports screen of FIG. 1, according to one embodiment.
Figure 6B:
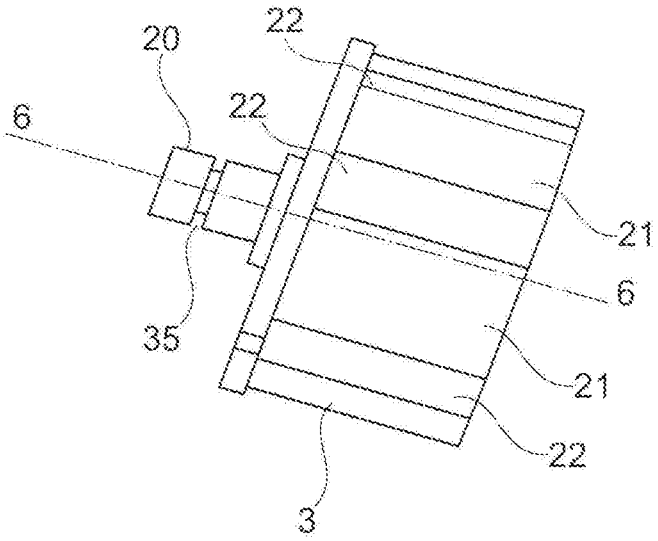

Head roll tube 1 is closed at its port-side end with idler end 3 which provides a secure mounting for an axle 20 (see FIG. 3) aligned with main axis 6 as shown in FIG. 1 and along line 6-6 of FIGS. 2, 6A and 6B.

Head roll tube 1 is rotated about its axis along line 6-6 to roll up and alternately, extend by unrolling, screen 10 as by operation of hand crank 12 or a motorized drive, with or without a remote control, not shown.

Middle bar 18, shown in FIG. 1, is constructed of two lengths of tubing (e.g. stiff fiberglass) and slid into an elongated horizontal transverse pocket 40 of the screen 10 approximately midway in its height. Middle bar 18 is generally not restrained laterally, extends the full width of screen 10 and is not connected to door frame 2 on either side.

Bottom bar 15 is similarly a pair of telescoped components (e.g. stiff fiberglass rods) engaged horizontally and laterally with each other in a pocket of screen 10.

Head roll tube 1 is closed at its starboard-side end with gear-box drive 9 engaged in torque transmitting relationship with tube 10 as by the telescoping fit shown in FIG. 2. Crank handle 12 engages with gearbox 11 secured between drive 9 and starboard-side angle bracket 10*b*.

In FIG. 3, head roll tube 1 is closed with port-side idler end 3 as by a telescoping, torque transmitting fitment including a series of lands 21, valleys 22 and an end cap 23 on idler end 3. Port side axle 20 may be molded in to idler end 3 for carriage of and rotation of tube 1 along axis 6 in conjunction with idler end 3 and axle 20. Axle 20 preferably includes an annular retaining groove 35 which is engaged with drop in bracket 5 for ready assembly in hard to reach places plus permanent but removable longitudinal alignment of head roll 1 with the end brackets 4 and 10 through gearbox 9.

Mounting assembly 200 comprises a mounting (e.g. angle) bracket 4 and a drop-in bracket 5. Mounting bracket 4 may have an L-shape which includes attachment holes 24 and 25 whereby mounting bracket 4 may be attached to a structure 2 (e.g. a garage door frame 2 or structure wall face 7). Mounting bracket 4 is provided with a plurality of pairs of fitment holes 26, 27, 28 and 29 with each a-b pair perpendicular to, radially aligned with and equally radially spaced from axle 6 about a common intersection point 30. Axle 20 is supported upon drop in bracket 5.

Drop-in bracket 5 is itself secured to mounting bracket 4 by a pair of screws 7 with corresponding nuts 8 using mounting holes 32*a* and 32*b* and a corresponding pair of fitment holes 26, 27 28 or 29 chosen for horizontal alignment along its axis 33 of drop-in bracket 5 with the ground. Drop-in bracket 5 includes an open receiver 31 for ease of assembly on site and a security lock pin 24 to retain axle 20 within receiver 31 in use. As can be seen, a port-side of mounting assembly 200 engages loading axle 20 and corresponding head roll tube 1 downward so that axle 6 engages in receiver 31 where it is restrained by lock pin 24 and annular groove 35, item 6 in the bill of materials above and in FIG. 2.

In FIG. 4, head roll tube 1 is closed with starboard-side gearbox drive 9 with an axle 20 corresponding to port-side axle 20 in FIG. 3 for rotation of drive 9 about axis 6. Gearbox 11 is secured between starboard-side angle bracket 10*b* and gearbox drive 9, as by bolts 14, which preferably pass through corresponding ones of holes 26, 27, 28 and/or 29 of bracket 10. Crank 12 is engaged with gearbox 11 to convert manual, or motor driven, rotation of crank 12 about it long axis into horizontal rotation of axle 20 and head roll 1 so as to deploy and retract the screen 10 across the garage door opening.

Figure 5:
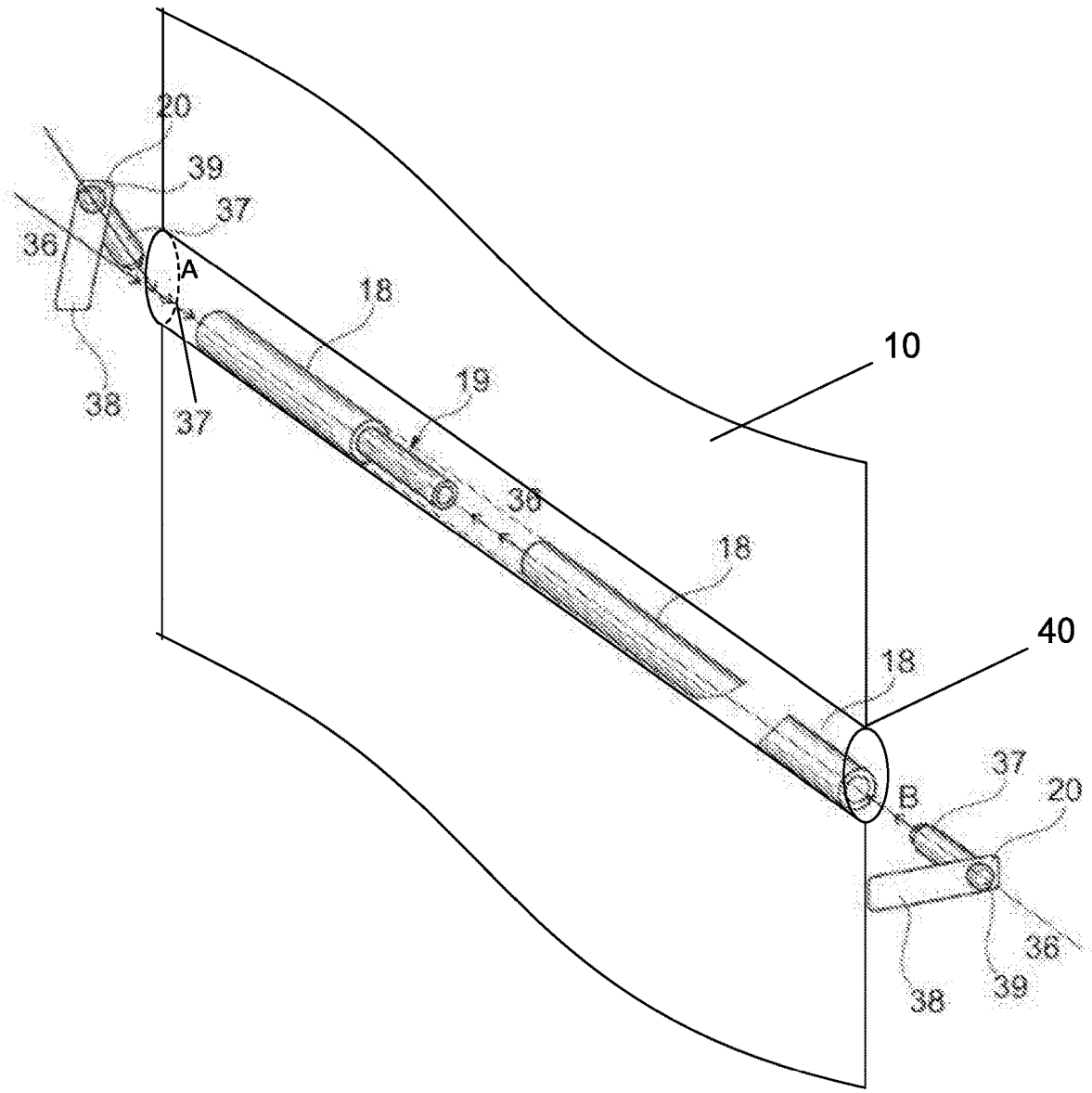
FIG. 5 is an expanded exploded view of the starboard end of the middle bar shown inside a pocket of the sport screen of FIG. 1, according to one embodiment.

In FIG. 5, middle bar 18 is shown in a perspective view exploded along its main axis 36. The two components of middle bar 18 are telescopically engaged with middle bar joiner 19 for a loose sliding fit. One of the portions of middle bar 18 may optionally be secured to joiner 19 as by set screws (not shown). In one embodiment, middle bar 18 is a hollow and flexible fiberglass tube adapted to resist impact forces on the screen 10 and is loosely engaged within a transverse and horizontal pocket 40 in the screen 10 or secured by a series of hoops for horizontal sliding motion.

Each end of middle bar 18 is provided with a Velcro end cap 20 including an insert 37 rotationally secured to strap 38 for rotation about axis 37 as by nut 39. Each Velcro cap is telescopically engaged with middle bar 18 as by alignment of its main axis 37 with the main axis 36 of the middle bar and loose insertion along directions A and B.

Screen 10 includes Velcro® catchment patches not shown at each lateral edge of pocket 40 or series of loops across the face which engage with Velcro® straps 38 to restrain Velcro® end caps 20 in relation to the screen 10 and to provide for a free sliding engagement of middle bar 18 across the screen 10 along axis 36, now horizontal.

Engagement of crank 12 will rotate head roll tube 1 about its long axis and roll up screen 10 around its length. Middle bar 18 and bottom bar 15 are rolled up along with the screen 10 ready for immediately use upon being unrolled.

While the above description provides examples of one or more apparatus, methods, or systems, it will be appreciated that other apparatus, methods, or systems may be within the scope of the claims as interpreted by one of skill in the art.

What is claimed is:

1. A retractable sport screen comprising:

(a) a head roll mountable to a structure;

(b) a screen coupleable to the head roll being movable between a first position and a second position, the screen being rolled up around the head roll when in the first position and extended towards a ground when in the second position;

(c) a middle bar received in a first pocket of the screen positioned at a mid-height between upper and lower ends of the screen when the screen is in the second position, the middle bar separating an upper panel of the screen from a lower panel of the screen, the first pocket of the screen constraining the middle bar when the screen is in the second position, each end of the middle bar including an end cap having an insert rotationally secured to a strap, each insert configured to telescopically engage the middle bar and each strap configured to engage catchment patches of the screen to restrain each end cap in relation to the screen;

(d) a bottom bar received in a second pocket of the screen and spaced from the middle bar in a direction away from the head roll when the screen is in the second position, the bottom bar being weighted to provide tension to the screen to inhibit a launched projectile striking the screen from contacting the structure when the screen is in the second position; and (e) a mounting assembly for mounting the head roll to the structure.

2. The sport screen of claim 1, wherein the head roll comprises a head roll tube and an axle extending from each end of the head roll.

3. The sport screen of claim 1, wherein the mounting assembly comprises a mounting bracket mountable to the structure and a drop-in bracket securable to the mounting bracket, the drop-in bracket having an upward-facing open receiver configured to engage an axle of the head roll.

4. The sport screen of claim 3, wherein the drop-in bracket is secured to the mounting bracket by fasteners, each fastener extending through one of a plurality of securing holes of the drop-in bracket and a corresponding one of a plurality of fitment holes of the mounting bracket.

5. The sport screen of claim 4, wherein the plurality of fitment holes of the mounting bracket are radially aligned with and radially spaced from a central point of the mounting bracket, the central point defined by an axis of the axles.

6. The sport screen of claim 3, wherein one of the axles extends from a first side of the head roll and comprises an annular retaining groove that engages the receiver of the drop-in bracket for the drop-in bracket to receive the axle.

7. The sport screen of claim 1 wherein the mounting assembly comprises a gear box for rotating the head roll and moving the screen between the first and second positions.

8. The sport screen of claim 7, wherein the mounting assembly further comprises a side bracket and a gear box drive, the gear box being positioned between the side bracket and the gearbox drive, the gear box drive engageable with an axle extending from a second side of the head roll.

9. The sport screen of claim 1, wherein the middle bar comprises two components telescopically engaged with a middle bar joiner.

10. The sport screen of claim 1, wherein the bottom bar comprises two components telescopically engaged with a bottom bar joiner.

11. The sport screen of claim 1, wherein the first pocket of the screen vertically constrains the middle bar when the screen is in the second position.

12. The sport screen of claim 1, wherein the middle bar is not restrained by the structure when the screen is in the second position.

13. The sport screen of claim 1, wherein the middle bar is not fixed to the structure when the screen is in the second position.

14. The sport screen of claim 1, wherein the middle bar is in free sliding engagement with the first pocket when the screen is in the second position.

15. The sport screen of claim 1, wherein the middle bar floats laterally between lateral edges of the screen when the screen is in the second position.

16. The sport screen of claim 1, wherein the middle bar is unconstrained laterally within the first pocket other than by the first pocket when the screen is in the second position.

17. The sport screen of claim 1, further comprising an overlay depicting a target on a front surface of the screen.

18. The sport screen of claim 17, wherein the overlay is attachable to the front surface of the screen.

19. The sport screen of claim 17, wherein the overlay is printed on the front surface of the screen.

* * * * *